US009598917B2

(12) United States Patent
Mullins et al.

(10) Patent No.: US 9,598,917 B2
(45) Date of Patent: Mar. 21, 2017

(54) FLUSH MOUNTED SPIDER ASSEMBLY

(71) Applicant: DrawWorks LP, Boling, TX (US)

(72) Inventors: Albert Augustus Mullins, Boling, TX (US); Matthew J. Hickl, El Maton, TX (US)

(73) Assignee: DRAWWORKS LP, Boling, TX (US)

( * ) Notice: Subject to any disclaimer, the term of this patent is extended or adjusted under 35 U.S.C. 154(b) by 400 days.

(21) Appl. No.: 14/226,541

(22) Filed: Mar. 26, 2014

(65) Prior Publication Data

US 2015/0275594 A1 Oct. 1, 2015

(51) Int. Cl.
*E21B 19/10* (2006.01)
*E21B 19/07* (2006.01)

(52) U.S. Cl.
CPC ..... *E21B 19/10* (2013.01); *E21B 19/07* (2013.01)

(58) Field of Classification Search
CPC ..... E21B 19/07; E21B 19/10
See application file for complete search history.

(56) References Cited

U.S. PATENT DOCUMENTS

| | | | | |
|---|---|---|---|---|
| 1,744,380 | A * | 1/1930 | Folsom | E21B 19/10 175/423 |
| 3,365,762 | A | 1/1968 | Spiri | |
| 3,579,752 | A | 5/1971 | Brown | |
| 3,748,702 | A | 7/1973 | Brown | |
| 4,275,487 | A | 6/1981 | Gray et al. | |
| 7,143,849 | B2 | 12/2006 | Shahin et al. | |
| 7,267,168 | B1 | 9/2007 | Sipos | |
| 7,775,270 | B1 | 8/2010 | Sipos | |
| 7,891,469 | B1 | 2/2011 | Sipos | |
| 8,146,671 | B2 | 4/2012 | Sipos | |
| 2003/0066718 | A1 | 4/2003 | Buck | |
| 2015/0021946 | A1* | 1/2015 | Vierke | E21B 19/07 294/86.24 |

* cited by examiner

*Primary Examiner* — David Andrews
*Assistant Examiner* — Abraham Laws
(74) *Attorney, Agent, or Firm* — Steve Rosenblatt

(57) ABSTRACT

A rotary table has a non-circular drive recess in the central opening which carries an assembly of mounting structures and slip carriers that when joined together fit in the non-circular drive recess. The plurality of slip carriers are distributed about the periphery of the drive recess are extended down into the central opening of the rotary table. A slip and die arrangement is situated on each slip carrier. Slip manipulation drive cylinders, are distributed about the assembly periphery and move a synchronizer plate that moves the slips vertically to grip or release pipe extending through the opening of the rotary table.

16 Claims, 3 Drawing Sheets

FLUSH MOUNTED SPIDER ASSEMBLY

FIELD OF THE INVENTION

The field of the invention is a slip carrier insert for a rotary table of a drilling rig and more particular where the slip carriers are integrated into a frame to fit a non-circular shaped opening in the rotary table.

BACKGROUND OF THE INVENTION

Drill strings are usually supported by spiders that fit in the opening of the rotary table. They usually have a slip bowl in which slips are peripherally distributed to surround the pipe to be gripped. The slip bowl opens upwardly. When a pipe string suspended in the well is to be gripped by the spider, the slips are moved downward. The slip bowl surface urges the downwardly moving slips to move radially inward to bear upon, and grip, the pipe. When the slips grips the pipe and load is transferred, the resulting downward force adds to the radially inward thrust of the slips, and largely defines the essential elements of what has become known as a failsafe system. Teeth carried by the slips contact the pipe to improve pipe security. The teeth may be on detachable dies that are carried by the slips.

Spiders are currently sold as an assembly which is inserted into the rotary table opening. Considerable design and engineering work has gone into the slip manipulation gear related to spiders. The spider housing, in effect, duplicates the function of the rotary table structure.

Larger tubulars, such as casing, are usually handled by spiders that rest on the rig floor above the rotary table. Such spiders are often capable of serving as elevators. The novel slip carriers and slip powering apparatus of this invention can be applied to such spider structures with minimum preparation.

Slips have to be secured to retain, or control, their peripheral distribution within the slip bowl. The slip control structure and slip manipulation gear makes up a considerable part of the usual spider. Such a composite spider can often function with minor, or no, adaptation as an elevator. In some cases, there is no way to distinguish a spider from an elevator.

Spiders and elevators, in many cases, have no power actuators and are strictly manual in operation. When composite spiders are prepared by the manufacturer for use in the field, they have limited adaptability to function for a variety of pipe sizes and, if considerable diversity of use is planned, several spiders have to be on hand or readily available. There is a need for spider sub-assemblies that can be fitted into rotary tables, or related structure, to enable adaptability. There is also a desire to have these spiders and sub-assemblies easy to disassemble, maintain, and replace. Current spiders are found in U.S. Pat. No. 7,891,469 B1, U.S. Pat. No. 3,748,702 A, U.S. Pat. No. 3,579,752, and U.S. Pat. No. 7,143,849 B2. They are purpose built to a specific size and not readily adaptable to different pipe sizes or rotary table openings.

The present invention is modular with the slip housings being integrated into the assembled shape. Dies on slips can be changed to accommodate various pipe sizes with minimal effort. The unit can be assembled around a tubular. These and other aspects of the present invention will be more fully understood by those skilled in the art from a review of the detailed description of the preferred embodiment and associated drawings while recognizing that the full scope of the invention is to be determined from the appended claims.

SUMMARY OF THE INVENTION

A spider can be made from several individual segments, that when configured together will fit in the non-circular recess drive of a rotary table. The spider will fit loosely into the rotary table so that any loads can be transferred directly to the rotary table recess. A mounting structure will serve to hold the non-continuous parts of the spider together until it is placed in the rotary table. The non-continuous peripherally distributed parts of the assembly have a slip manipulation surface which slopes downward toward the vertical center line of the rotary table. On each surface a slip will travel, so that when the slip moves down, it also radially constricts. With upward motion the slip radially expands. The slips also have a changeable set of dies to allow quick and easy adaption to different size pipes. The slips are powered by a linear motor in both directions. This will allow for powered radial movement in both directions. The slips will be timed together so that they contact and evenly apply pressure on the pipe being gripped. At least one section of the spider and timing ring may also be easily removed so that a pipe can pass through at least one of its sides. By making some of these parts identical, manufacturing and inventory can be reduced.

DETAILED DESCRIPTION OF THE PREFERRED EMBODIMENT

Figure 1A:
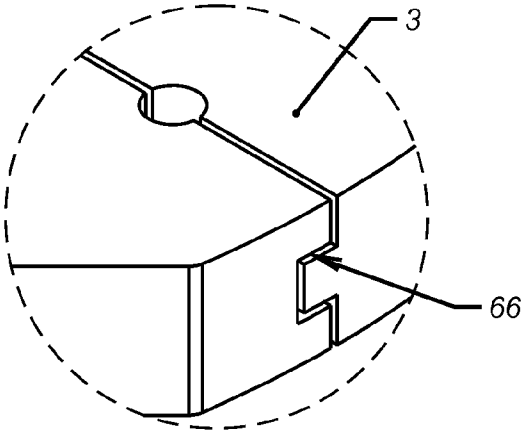
FIGS. 1 and 1*a* show a perspective view of a complete assembly as it goes into the rotary table and an enlarged view of an alignment dovetail.
Figure 1:
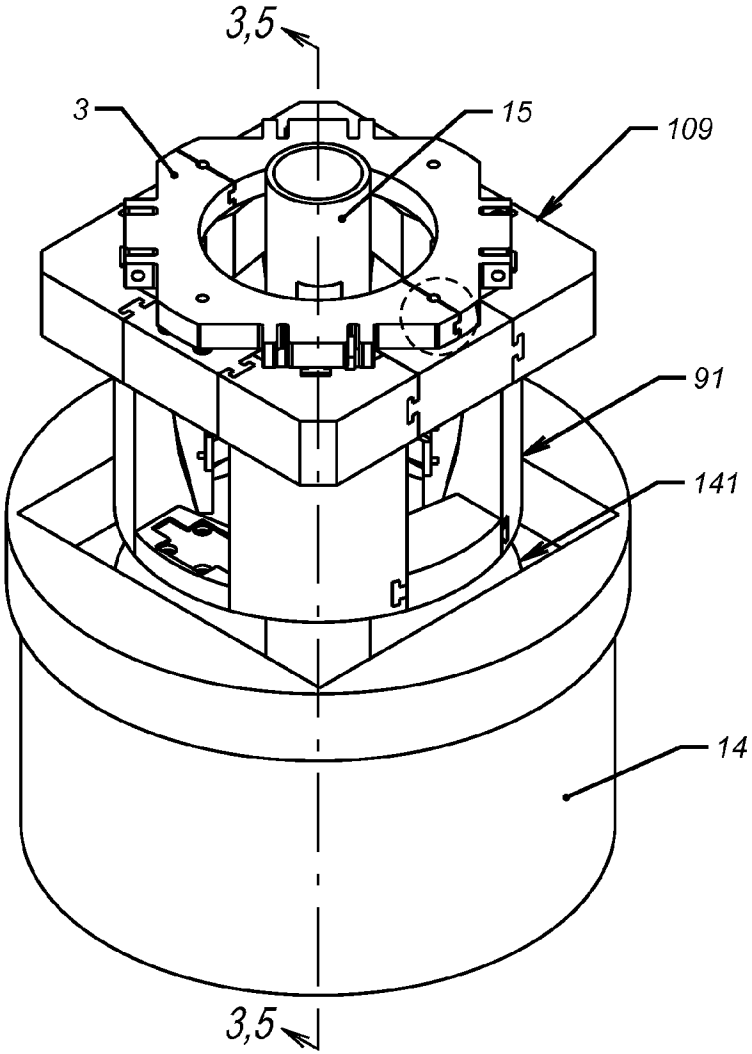

In FIG. 1 the complete assembly 109 fits the recess in the rotary table 14. The pipe 15 is placed through the center of the assembly 109 and rotary table 14. When lowered, outer surface 91 is radially restrained by surface 141 of rotary table 14. The detailed view shows the tongue and groove design 66 used to keep the timing plate 3 in time, but allows easy separation, if disassembly is required. Other means of removable communication can be used.

Figure 2:
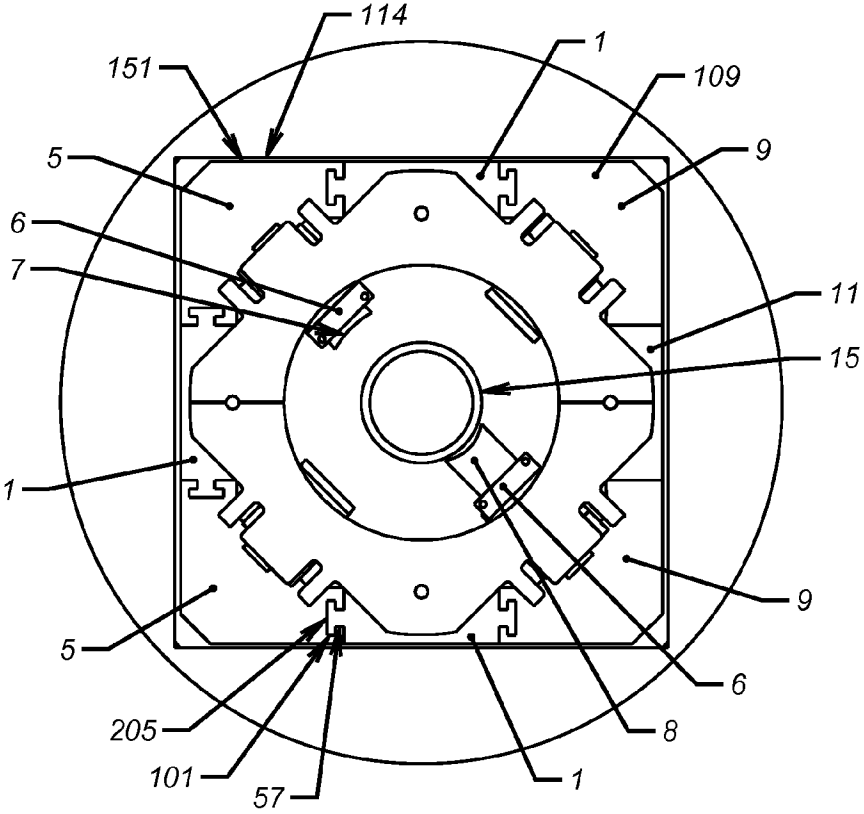
FIG. 2 is a plan view of the view in FIG. 1 in the pipe gripping position.

In FIG. 2 the non-circular recess 114 fits the non-circular geometry 151 made by the assembly 109 that will transmit torque.

The assembly 109 is made up from slip carriers 5 and 9 and intervening mounting structures 1 and 11. The slip carriers 5 and 9 and mounting structure 1 and 11 are held together by a T-Slot 57, where slot surface 205 and 101 restrict each other. These t-slots can be formed in different orientations. Other methods of removable joining can be used such as bolts or pins. The pipe 15 is fixed by the dies 8 or 7 depending on the size. When in use all the dies would be the same size but in FIG. 2 die 7 and die 8 are shown as different sizes demonstrating the size variation available by only changing dies.

Figure 3:
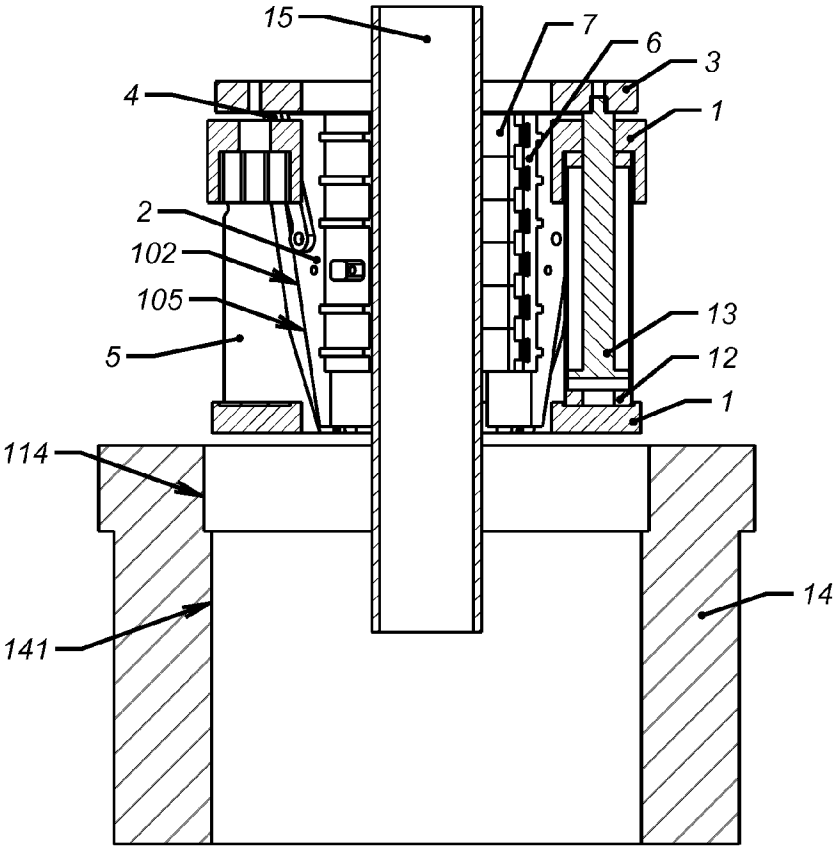
FIG. 3 is a section view along lines 3-3 of FIG. 1 in the pipe gripping position.
Figure 5:
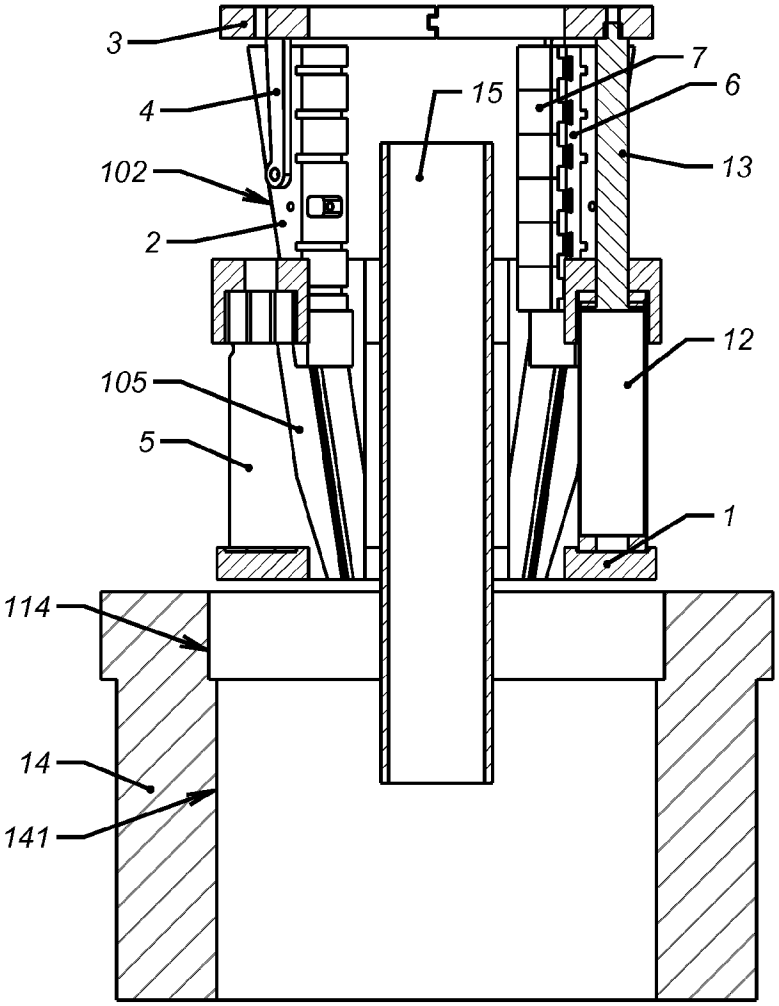
FIG. 5 is a section view along lines 5-5 of FIG. 1 in the pipe released position.

In FIG. 3 the slip carrier 5 has inward sloped ramps 105 that mate with slip 2 on slip surface 102. There is a dovetail grove, t-slot, or other means to keep the surfaces coincident as would be familiar to those skilled in the art. Connecting link 4 attaches to timing plate 3 and slip 2 so that all the slips are connected to the timing plate 3 and respond to its movement. Movement in one direction will grip the pipe 15, while movement in the other will release the pipe 15 as shown in FIG. 5. The gripping force on the pipe will be enough so that a torqueing force from the pipe 15 will travel through the dies 7 into the removable grip element 6 into slips 2 into slip carriers 5 which are supported by rotary table 14 and non-circular recess 114. Movement of timing plate 2 is controlled by hydraulic cylinder rod 13 which operates in the hydraulic cylinder 12. Other means of linear travel can be used. Hydraulic cylinder 12 can also be used to link mounting structures 1 together. The timing plate is non-continuous so that it can be separated. Removable pipe gripping elements 6 can be fitted with different sized dies 7 to accommodate different sized pipe as seen in FIG. 2 when comparing dies 7 and 8.

Figure 4:
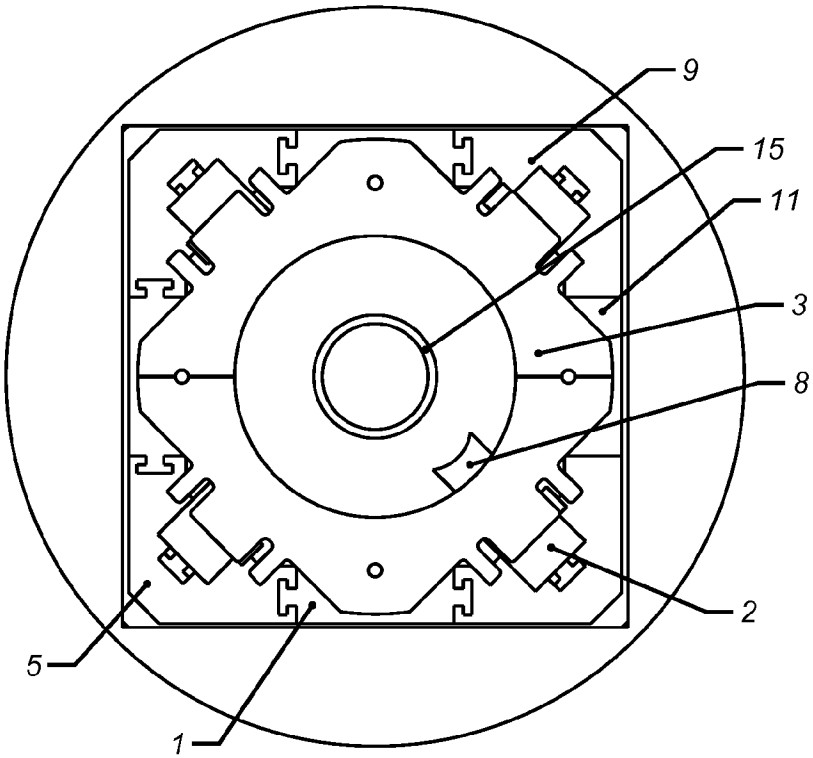
FIG. 4 is a plan view of FIG. 1 in the pipe released position.

In FIGS. 4 and 5 the dies 8, grip element 6, and slip 2 have been raised and radially retracted by timing plate 3 which allows the pipe 15 to move.

FIG. 5 shows a better view of the raised members when comparing to FIG. 3. Slip carrier surface 105 and slip surface 102 are still held coincident by t slot or dovetail grove or other means not shown.

Those skilled in the art will appreciate the unique advantages of the present invention. The guides for the slips are integrated with the top of the frame to transmit torque from the gripped pipe directly into the rotary table opening. The slip guides are an integral part of the top of the frame at its corners and slip into contact with intermediate connecting pieces. This type of mounting allows resizing of the frame for different rotary table sizes by substitution of the corner pieces or the connecting pieces or both. Torque from the gripped pipe goes into the corner pieces that support the slip guides directly as opposed to a separate ring structure that caps the slip guide support members shown in U.S. Pat. No. 7,891,469. Links pivoted on opposed ends connect the slips to the timing plate to convert the axial movement of the timing plate into radial movement of the slips into the pipe along slanted guides such as a dovetail.

The frame has a base and spaced members that are interconnected with connecting members to define a segmented ring that has a top surface in preferably a single plane. The interconnecting members have at least one that is longer than the pipe to be grabbed so that the segmented ring can be partially assembled and slipped over a pipe and then completed. The connection between the spaced members and the interconnecting members can be of a projection and depression combination of surfaces. The spaced members support slip guides and have a surface that contacts a wall that defines the opening in the rotary table. The slip guides a sloped and the slips ride on the guides connected with a pivoting link from an operating ring that is segmented and moves the slips in tandem with hydraulic pistons so that axial movement is translated to radial movement of the slips that have a die on the grip face for gripping the pipe without damage. The dies can be replaced with other dies of different sizes to handle different pipe diameters in the same frame structure. The segmented ring size can be easily changed with replacing the spaced members or the interconnecting components or both to handle different sizes of rotary tables with minimal part inventories.

The above description is illustrative of the preferred embodiment and many modifications may be made by those skilled in the art without departing from the invention whose scope is to be determined from the literal and equivalent scope of the claims below:

We claim:

1. A pipe gripping apparatus for placement in a rotary table opening, comprising:

a base having a lower passage for the pipe to pass through, said base shaped to enter said opening;

a plurality of spaced members extending from said base and terminating in upper ends with interconnecting members therebetween, adjacent said upper ends, to define a closed segmented ring structure with an outer periphery having the shape of said opening for direct torque resistance transmitted from the pipe when supported by movable slips that are supported by said spaced members;

said interconnecting members separating said spaced members to form said closed segmented ring structure while enabling dimensional change of said ring structure with interconnecting members of different dimensions.

2. The apparatus of claim 1, wherein:

said interconnecting members have guided opposed ends at said spaced members.

3. The apparatus of claim 1, wherein:

said interconnecting members are secured to said spaced members with a projection and depression.

4. The apparatus of claim 1, wherein:

said interconnecting members have a top surface in a common plane with said upper ends of said spaced members.

5. The apparatus of claim 1, wherein:

said spaced members supporting slip guides with a guide orientation skewed with respect to a vertical axis of said base.

6. The apparatus of claim 5, wherein:

said slips each connected to an operating ring with at least one pivoting link.

7. The apparatus of claim 6, wherein:

said spaced members further comprising a hydraulic piston operably connected to said operating ring.

8. The apparatus of claim 6, wherein:

said operating ring is made of at least one segment.

9. The apparatus of claim 5, wherein:

said slip guides selectively support slips of different dimension to selectively engage pipes of different diameters.

10. The apparatus of claim 1, wherein:

said interconnecting members are longer than the pipe diameter to be selectively retained by said slips such that said segmented ring without one of said interconnecting members can be slipped over the pipe diameter and completed around the pipe by adding said one interconnecting member.

11. The apparatus of claim 1, wherein:

said spaced members contact a wall that defines the rotary table opening.

12. The apparatus of claim 1, wherein:

said outer periphery of said segmented ring structure can be changed with substitution of interconnecting members of a different length.

13. The apparatus of claim 1, wherein:

said outer periphery of said segmented ring structure can be changed with substitution of spaced members of a different dimension.

14. The apparatus of claim 1, wherein:

said outer periphery of said segmented ring structure can be changed with substitution of spaced members of a different dimension and interconnecting members of a different length.

15. The apparatus of claim 1, wherein:

said slips further comprise a removable die for selective engagement of the pipe.

16. The apparatus of claim 1, wherein:

said segmented ring structure outer periphery for directly opposes radial forces from the pipe when supported by movable slips that are supported by said spaced members.

* * * * *